United States Patent [19]

Roy et al.

[11] Patent Number: 4,879,989

[45] Date of Patent: Nov. 14, 1989

[54] TOY STACKING AND KICKING MECHANISM

[75] Inventors: David C. Roy; Marjorie E. C. Roy, both of Stafford Springs, Conn.

[73] Assignee: The Quaker Oats Company, Chicago, Ill.

[21] Appl. No.: 102,110

[22] Filed: Sep. 29, 1987

[51] Int. Cl.[4] ..... A63H 13/00

[52] U.S. Cl. ..... 124/79; 124/49; 446/333; 446/227

[58] Field of Search ..... 124/79, 1, 41 R, 31, 124/37, 49; 446/227, 359, 360, 429, 333

[56] References Cited

U.S. PATENT DOCUMENTS

| | | | |
|---|---|---|---|
| 1,279,615 | 9/1918 | Van Meter | 446/227 |
| 1,516,023 | 11/1924 | Marx | 124/1 |
| 1,644,047 | 10/1927 | Wetzell | 124/79 |
| 1,678,527 | 7/1928 | Payne | 124/79 |
| 2,506,190 | 5/1950 | Barnes | 124/79 |
| 2,921,792 | 1/1960 | Guss | 124/79 |
| 3,804,071 | 4/1974 | Winrow | 124/41 R |
| 4,085,540 | 4/1978 | Jernstrom et al. | 446/333 |

FOREIGN PATENT DOCUMENTS

| | | | |
|---|---|---|---|
| 72499 | 5/1916 | Switzerland | 446/333 |
| 697446 | 9/1953 | United Kingdom | 124/79 |

*Primary Examiner*—Randolph A. Reese
*Assistant Examiner*—Anthony Knight
*Attorney, Agent, or Firm*—Cumpston & Shaw

[57] ABSTRACT

A toy stacking and kicking mechanism is disclosed having a support base, and a hollow post extending upwardly from the support base. The outer surface of the post is preferably designed and shaped as a brightly colored character, such as a clown or the like that is attractive to children, and the top of the post is designed as a hat. A plurality of generally U-shaped objects, each having a center opening and a passage extending from the center opening through the object at one end thereof, is stacked on the support base of the post. A foot member is pivotally mounted within the hollow post and is movable from a retracted position to an extended position in which the foot member passes through a slot in a wall of the post for engaging and kicking the lowermost object from the support base.

9 Claims, 3 Drawing Sheets

TOY STACKING AND KICKING MECHANISM

FIELD OF THE INVENTION:

The present invention relates generally to toys, and more specifically to a toy mechanism for stacking objects and then kicking them off the bottom of the stack one at a time.

BACKGROUND OF THE INVENTION:

The need constantly exists for clever and ingenious toys which will provide infants in a crib or a playpen with great enjoyment. Accordingly, an object of the present invention is to provide a toy for infants that is stimulating, of simple design and construction, and economical to manufacture.

SUMMARY OF THE INVENTION:

An object of this invention is accomplished by providing a mechanism for stacking and kicking generally U-shaped objects having a center opening and a passage extending from the center opening through the object at one end thereof, comprising:

a support base;

a post extending upwardly from the support base through the center opening in an object for guiding and stacking one or more objects onto the support base; and kicking means on the post for kicking an object from the support base.

A further object of the invention is accomplished by providing a hollow post in which the kicking mechanism is mounted. The kicking mechanism comprises a pair of leg members, each having one end secured to a complementary foot member, and the opposite end pivotally mounted within the post. The opposite ends of the leg members further have transversely extending shelf members overlapping one another, the free end portions thereof forming a shelf. A spring biases the leg members together for holding the foot members in a retracted position. The head of the post forms an actuating means for engaging and moving the end portions of the shelf members downwardly causing the foot members to move to an extended position.

DESCRIPTION OF THE DRAWINGS:

In the detailed description of the invention presented below, reference is made to the accompanying drawings, in which.

Figure 4:
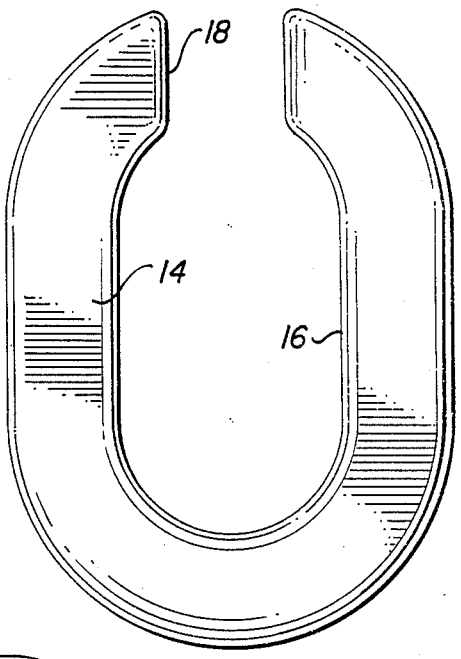
FIG. 4 is top plan view of an object of the type that may be stacked on the mechanism and kicked off the support base.

DETAILED DESCRIPTION OF THE INVENTION:

With reference to FIGS. 1–4, a preferred embodiment of the toy stacking and kicking mechanism of this invention comprises a support base 10, and a hollow post 12 integral with and extending upwardly from the support base. The outer surface of post 12 is designed and formed as a character appealing to infants, such as a brightly colored clown or the like. The body of post 12 preferably has an oblong-shaped cross-section over which oblong-shaped objects 14, such as shown in FIG. 4, are dropped and stacked on support base 14. The object 14 is preferably constructed of soft plastic material, has an oblong-shaped center opening 16, and a passage 18 at one end thereof extending from the center opening through the object.

Figure 1:
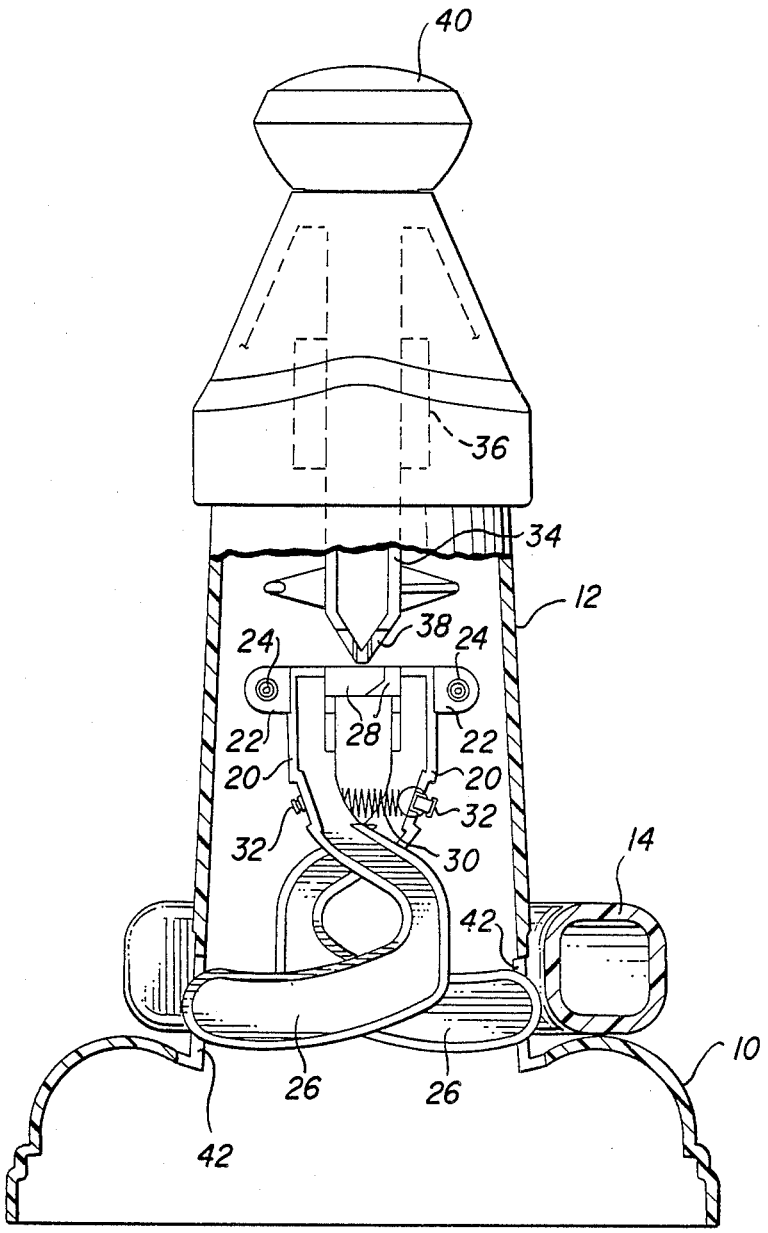
FIG. 1 is a front-elevational view of a preferred embodiment of a toy stacking and kicking mechanism of this invention with a portion thereof broken away to show the kicking mechanism in its retracted position.

The mechanism for kicking the lowermost object 14 of a stack of objects from support base 10 comprises a pair of leg members 20 having one of the ends 22 thereof pivotally mounted in opposed side-by-side relation on a suitable support 24 on the body. A pair of foot members 26 are integrally connected with the opposite ends of leg members 20. The ends 22 of leg members 20 are further provided with laterally extending overlapping shelf members 28 which cooperate to form a shelf. A helical spring 30 interconnects lugs 32 on leg members 20 for biasing the leg members into a retracted position in which foot members 26 are generally within hollow post 12, as best seen in FIG. 1.

Figure 2:
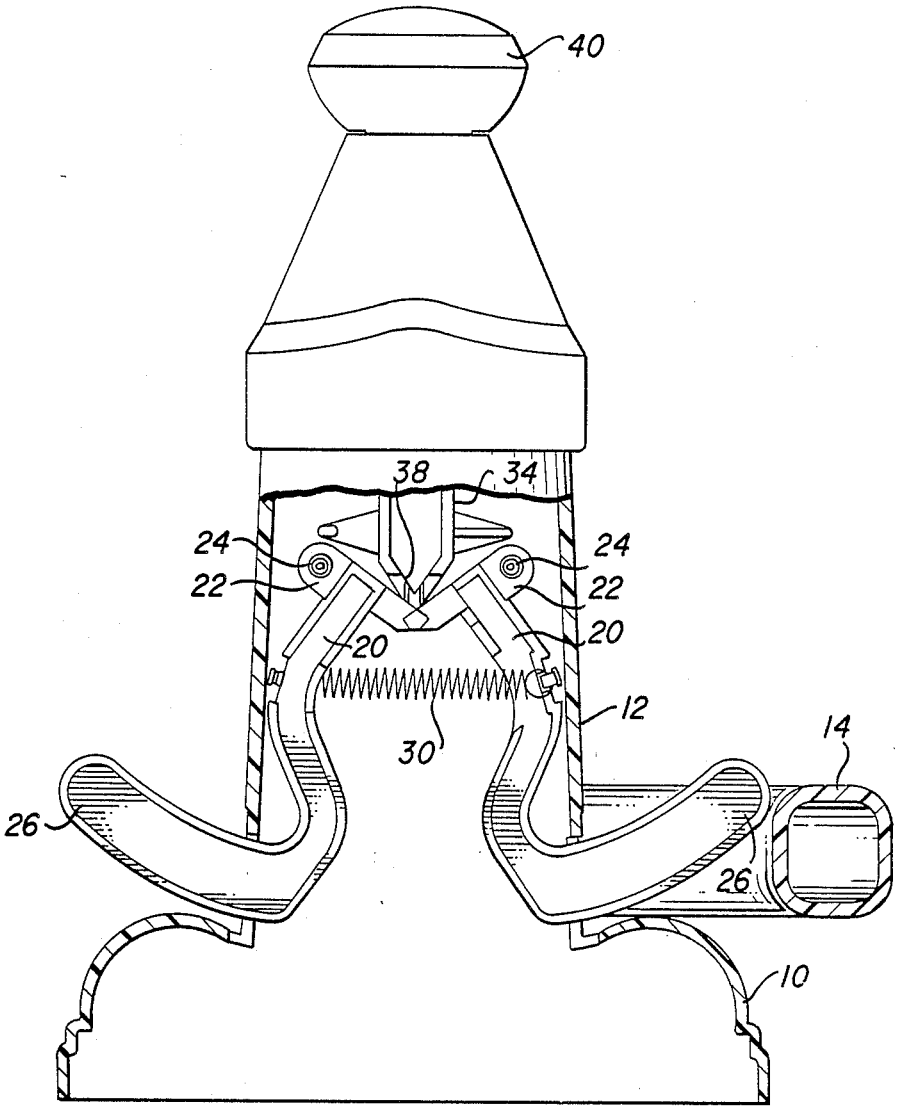
FIG. 2 is a front-elevational view similar to FIG. 1 showing the kicking mechanism in its extended position for kicking the lowermost object from the support base.
Figure 3:
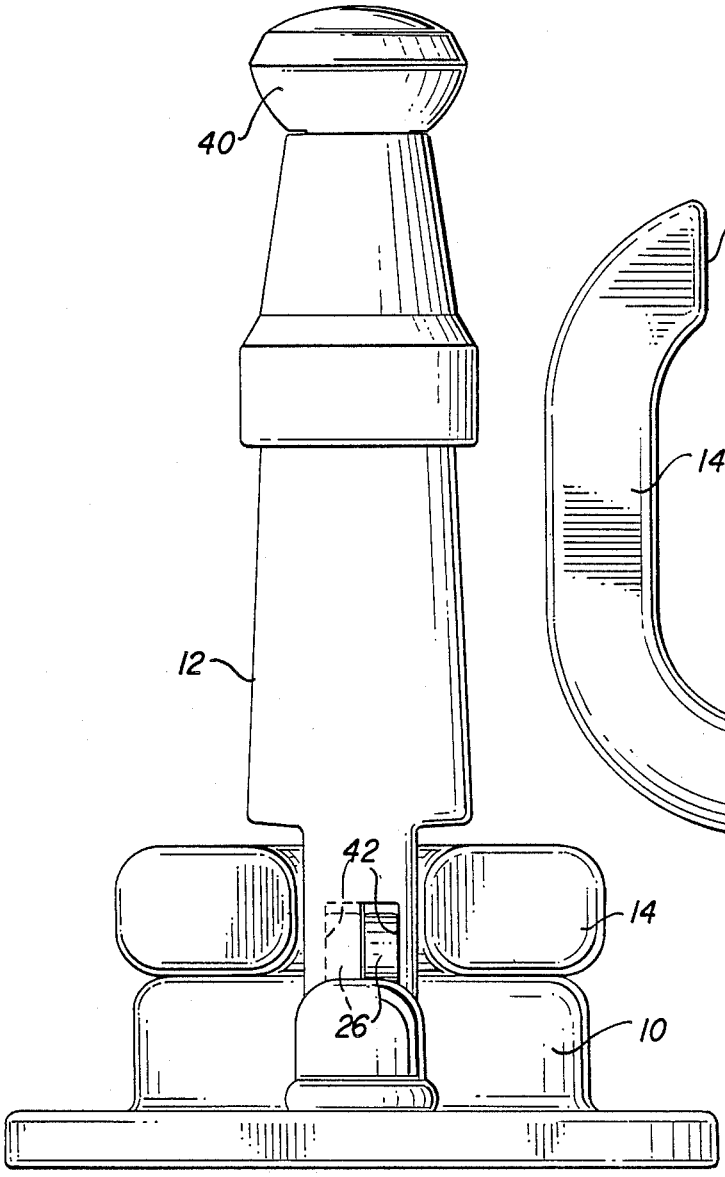
FIG. 3 is a side-elevational view of the toy stacking and kicking mechanism of this invention.

The actuating mechanism for moving the kicking mechanism from a retracted position to an extended position, shown in FIG. 2, will now be described. The actuating mechanism comprises a shaft 34 mounted for reciprocal movement within bearing 36 in post 12 generally along the center line thereof. The shaft 34 has a pointed end 38 engagable with shelf member 28, and a cap 40 secured to the opposite end by which shaft 34 can be manually moved downwardly by a person's hand or foot for moving foot members 26 through complementary slots 42 in the post wall to an extended position. When the manual pressure on cap 40 is released, spring 30 returns foot members 26 to their retracted position, as seen in FIG. 1. During the kicking action, one foot member 26 passes through passage 18 in object 14 and the other foot member 26 engages the portion of the object opposed to passage 18 for kicking the object from support base 10.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A mechanism for stacking and kicking generally U-shaped objects having a center opening and a passage extending from the center opening through the object at one end thereof, comprising:

a support base;

a post extending upwardly from the support base through the center opening in each of a plurality of objects for guiding and stacking said plurality of objects one above the other on the support base; and kicking means on the post for kicking one of said objects at a time from the support base.

2. A stacking and kicking mechanism according to claim 1 wherein the post is hollow and defines a generally rectangular wall in cross-section which generally conforms to the shape of the center opening, the post further having a slot extending through the wall thereof, and wherein the kicking means is mounted within the post and comprises a foot member movable from a normal retracted position to an extended position through the slot for kicking the object from the support base.

3. A stacking and kicking mechanism according to claim 2 wherein a pair of opposed slots extend through the opposed shorter wall sections of the rectangular wall, wherein the post guides the object onto the support base with the passage therein in alignment with one of the slots, and wherein the kicking means comprises a pair of foot members movable to an extended position through the slots for kicking the object from the support base.

4. A stacking and kicking mechanism according to claim 3 wherein the kicking means comprises a pair of leg members, each having one end secured to a complementary foot member and the opposite end pivotally mounted on the post, the opposite ends of the leg members further having transversely extending shelf members overlapping one another and having the free end portions thereof cooperating to form a shelf, the kicking means further comprising a spring for biasing the leg members together for holding the foot members in their retracted position, and actuating means for engaging and moving the end portions of the shelf members causing the foot members to move to their extended positions.

5. A stacking and kicking mechanism according to claim 4 wherein the actuating means comprises a shaft mounted for reciprocal movement in the post and having one end thereof engagable with the end portions of the shelf members, and the opposite end having a cap by which the shaft can be depressed for moving the foot members from their retracted positions to their extended positions, the spring returning the foot members to their retracted positions when the cap is released.

6. A mechanism for stacking and kicking flat oblong-shaped objects having a center oblong-shaped opening and a passage extending from the opening through the object at one end thereof, comprising:

a support base;

a hollow post having a slot extending therethrough, the post extending upwardly from the support base through the oblong-shaped center opening in each of a plurality of objects for guiding and stacking the objects onto the support base with the passage and portion of each of said objects opposed thereto in alignment with the slot; and kicking means mounted within the hollow post for kicking one of said objects at a time from the support base, the kicking means having a foot member in alignment with the slot and movable from a normal retracted position within the post to an extended position through the slot for engaging the portion of the object and kicking the object from the support base.

7. A stacking and kicking mechanism according to claim 6 wherein a pair of opposed slots extend through the opposed shorter wall sections of the oblong-shaped wall, wherein the post guides the object on to the support base with the passage therein in alignment with one of the slots, and wherein the kicking means comprises a pair of foot members movable to an extended position through the slots for kicking the object from the support base.

8. A stacking and kicking mechanism according to claim 7 wherein the kicking means comprises a pair of leg members, each having one end secured to a complementary foot member and the opposite end pivotally mounted on the post, the opposite ends of the legs members further having transversely extending shelf members overlapping one another and having the free end portions thereof cooperating to form a shelf, the kicking means further comprising a spring for biasing the leg members together for holding the foot members in their retracted position, and actuating means for engaging and moving the end portions of the shelf members causing the foot members to move to their extended positions.

9. A stacking and kicking mechanism according to claim 8 wherein the actuating means comprises a shaft mounted for reciprocal movement in the post and having one end thereof engagable with the end portions of the shelf members, and the opposite end having a cap by which the shaft can be manually depressed for moving the foot members from their retracted positions to their extended position, the spring returning the foot members to their retracted positions when the cap is released.

* * * * *